US006527358B2

(12) United States Patent
Kuriyama et al.

(10) Patent No.: US 6,527,358 B2
(45) **Date of Patent: *Mar. 4, 2003**

(54) PRINTING APPARATUS AND INK-DISCHARGE STATUS DETECTION METHOD

(75) Inventors: Hiroyuki Kuriyama, Kawasaki (JP); Yasushi Miura, Kawasaki (JP); Masashi Shimizu, Kawasaki (JP); Chikanobu Ikeda, Tokyo (JP); Shigeru Watanabe, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/215,326

(22) Filed: Dec. 18, 1998

(65) Prior Publication Data

US 2002/0140756 A1 Oct. 3, 2002

(30) Foreign Application Priority Data

Dec. 25, 1997 (JP) ..... 9-358400

(51) Int. Cl.[7] ..... B41J 29/393
(52) U.S. Cl. ..... 347/19
(58) Field of Search ..... 347/19, 14, 11, 347/12

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,723,129 A | | 2/1988 | Endo et al. | 346/1.1 |
| 4,740,796 A | | 4/1988 | Endo et al. | 346/1.1 |
| 5,530,460 A | * | 6/1996 | Wehl | 347/19 |
| 6,076,910 A | * | 6/2000 | Anderson | 347/19 |

FOREIGN PATENT DOCUMENTS

| | | | |
|---|---|---|---|
| EP | 0 380 056 | 8/1990 | |
| EP | 0 744 295 | * 11/1996 | |
| EP | 0 794 060 | 9/1997 | |
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |
| JP | 63 260449 | 10/1988 | |
| JP | 4-197757 | 7/1992 | |
| JP | 4-269549 | 9/1992 | |
| JP | 8-332735 | 12/1996 | |
| JP | 9-94946 | 4/1997 | |
| JP | 9-94948 | 4/1997 | |
| JP | 10 193643 | 7/1998 | |

OTHER PUBLICATIONS

Office Action dated Aug. 26, 2002 in Japanese patent application No. 9–358400.

* cited by examiner

*Primary Examiner*—John Barlow
*Assistant Examiner*—Ly T Tran
(74) *Attorney, Agent, or Firm*—Fitzpatrick, Cella, Harper & Scinto

(57) ABSTRACT

A printing apparatus and an ink-discharge status detection method which perform appropriate print control by detecting discharge failure with a simple construction, without reducing the printing speed. The apparatus, to which the method is applied, performs test ink discharge from a part of nozzles of a printhead while scanning the printhead, and detects ink discharge statuses of the nozzles of the printhead by using a photosensor in an area between the home position of the printhead and a position outside of an effective printing area. In next detection, nozzles different from those used in the previous test ink discharge are used for performing test ink discharge, and discharge statuses are detected. Discharge statuses of all the nozzles are detected in forward and backward scannings or a plurality of scannings.

13 Claims, 13 Drawing Sheets

PRINTING APPARATUS AND INK-DISCHARGE STATUS DETECTION METHOD

BACKGROUND OF THE INVENTION

This invention relates to a printing apparatus and an ink-discharge status detection method, and more particularly, to a printing apparatus having a printhead, including a plurality of nozzles, to perform printing in accordance with an ink-jet method, and an ink-discharge status detection method used in the printing apparatus.

A printer which performs printing in accordance with the ink-jet method has a plurality of fine nozzles integrated in a high density. The printer directly discharges ink from the nozzles onto a print medium, thus forms an image by the ink dots. If impurities (dust) enter a nozzle, the ink adheres to a portion around the ink discharge orifice, or the nozzle is clogged with the impurities or the adhered ink, ink discharge failure may occur. Further, in a method of heating ink to cause film boiling and discharge the ink by the pressure of bubbles produced in a nozzle (so-called bubble-jet method), ink discharge failure may occur if disconnection occurs in a heater of the nozzle.

The ink discharge failure considerably degrades the quality of a printed image. Especially, in a production-material manufacturing apparatus such as an apparatus used for textile printing which requires very high image quality, the discharge failure is a serious problem which might lower the reliability of the apparatus.

Conventionally, a several methods have been proposed as follows to detect the discharge failure status.

(1) A print medium for detecting ink-discharge status is provided outside of an effective printing area by a printhead. Then, a pattern enabling discrimination of a nozzle in discharge failure status is printed on the print medium. Next, the pattern is optically read by using an optical reader such as a CCD camera, and a nozzle in the discharge failure status, if exists, is determined. In this case, the optical reader can be moved to the position of the print medium, otherwise, a disk or roller-shaped print medium may be used such that the print medium can be rotated to the position of the optical reader.

(2) A light emitting device is provided such that a light beam emitted from the device passes through an area outside of an effective printing area by a printhead. Then, a printhead is stopped around the light axis of the light beam, and ink is discharged to block the light beam. The light beam is received by a photoreception device provided at a position opposite to the light emitting device, and it is determined whether or not discharge failure has occurred based on output from the photoreception device. According to this method, in use of a color printhead having a plurality of nozzle arrays corresponding to a plurality of color ink, the detection must be performed for the number of the nozzle arrays (the number of ink colors).

However, in the above conventional techniques, the print medium for detection or the optical reader must be moved for the discharge failure detection, or the printhead must be moved in a complicated manner different from that in normal print operation for the discharge failure detection. Accordingly, the apparatus must comprise a complicated mechanism, and further, the total printing speed of the apparatus is reduced.

SUMMARY OF THE INVENTION

Accordingly, it is an object of the present invention to provide a printing apparatus and an ink-discharge status detection method to detect discharge failure status and perform appropriate print control with a simple construction, without reducing the printing speed.

According to one aspect of the present invention, the foregoing object is attained by providing a printing apparatus which performs printing by discharging ink onto a print medium while scanning a printhead, based on an ink-jet method, having a plurality of printing elements, the apparatus comprising: scan means for scanning the printhead; print means for performing print operation by using the printhead; test discharge means for controlling operation of the printhead to select at least a part of the plurality of printing elements and perform test ink discharge while the scan means scans the printhead; detection means for detecting ink-discharge statuses of the plurality of printing elements of the printhead from the test ink discharge by the test ink discharge means; and first control means for controlling the test discharge means to sequentially select the printing elements of the printhead at each of plural scannings of the printhead by the scan means, and controlling the detection means to detect the ink-discharge statuses.

Note that it is preferable that the detection means is provided between a home position of the printhead, at one end of a scanning path of the printhead, and a position outside of an effective printing area for the printhead.

Further, it is preferable that the test discharge means includes: first test discharge means for controlling the operation of the printhead to select a part of the plurality of printing elements and perform test ink discharge while the scan means scans the printhead in a forward direction; and second test discharge means for controlling the operation of the printhead to select another part of the plurality of printing elements, different from the part of the printing elements selected by the first test discharge means, and perform ink discharge while the scan means scans the printhead in a backward direction.

Further, it is preferable that the apparatus further comprises: analysis means for detecting ink discharge statuses obtained by the first and second test discharge means by using the detection means, and analyzing operation statuses of the plurality of printing elements of the printhead based on the results of detection; and second control means for controlling the print operation by the print means, based on the analysis result.

Note that it is preferable that the plurality of printing elements of the printhead are arrayed in one line, and the detection means includes: light emission means for emitting a light beam; and photoreception means for receiving the light beam, and that the printhead is provided such that ink droplets discharged from the plurality of printing elements block the light beam. Further, it is preferable that the light emission means and the photoreception means are provided such that a light axis of the light beam intersects an array direction of the plurality of printing elements of the printhead.

Further, it may be arranged such that the ink discharge statuses of all of the plurality of printing elements of the printhead can be detected by operating the first and second test discharge means totally a predetermined number of times.

Further, it may be arranged such that the test discharge means uses a control signal the same as that used by the print means, and performs the ink discharge only by changing image data and timing for ink discharge. Further, it is preferable that a moving speed of the printhead while the test discharge means operates and that while the print means performs the print operation are the same.

Further, it may be arranged such that the printhead is a color printhead which discharges ink of plural colors, and which has a plurality of printing element arrays each comprising the plurality of printing elements corresponding to the plural colors. In this case, the plurality of printing elements selected by the test discharge means are determined based on a distance between the plurality of printing element arrays, a moving speed of the printhead, the number of printing elements consisting the plurality of printing element arrays, the length of printing by each of the plurality of printing element arrays, a printing resolution in a printhead scanning direction, an ink discharge period in the printhead scanning direction, and a distance between the printing elements of the printing element arrays.

Note that the printhead is an ink-jet printhead having discharge nozzles to discharge ink, respectively corresponding to the plurality of printing elements, and preferably, the printhead has electrothermal transducers for generating thermal energy to be provided to ink so as to discharge the ink by utilizing the thermal energy.

According to another aspect of the present invention, the foregoing object is attained by providing an ink-discharge status detection method used upon printing by discharging ink onto a print medium while scanning a printhead, based on an ink-jet method, having a plurality of printing elements, the method comprising: a test discharge step of controlling operation of the printhead to select at least a part of the plurality of printing elements and perform test ink discharge while scanning the printhead; a detection step of detecting ink-discharge statuses of the plurality of printing elements of the printhead based on the test ink discharge at the test ink discharge step; and a control step of controlling execution of the test discharge step to sequentially select the printing elements of the printhead at each of plural scannings of the printhead, and controlling execution of the detection step to detect the ink-discharge statuses.

Note that it is preferable that the detection step is performed when the printhead is situated between a home position of the printhead, at one end of a scanning path of the printhead, and a position outside of an effective printing area for the printhead.

In accordance with the present invention as described above, the ink-discharge status detection is performed such that ink is discharged onto a print medium while the printhead, based on the ink-jet method, having the plurality of printing elements is scanned. When the printhead is scanned, the operation of the printhead is controlled to perform test ink discharge from at least a part of the printing elements. For example, ink-discharge statuses of the plurality of printing elements of the printhead are detected, based on test ink discharge performed at an area between the home position of the printhead at one end of the scanning path of the printhead and a position outside of the effective printing area for the printhead. The test ink discharge is performed such that a predetermined number of printing elements are sequentially selected from the printing elements of the printhead at each scanning of a plural number of scannings and test discharge is performed.

The invention is particularly advantageous since the ink-discharge status detection can be implemented in the process of normal print operation without causing the printhead to perform any specific operation.

Accordingly, the ink-discharge status detection can be efficiently performed with a simple construction, without reducing the printing speed and without using a specific print control or mechanism. Further, the present invention omits conventionally required various mechanisms for ink-discharge status detection, thus contributing to the downsizing and the reduction of production cost.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiment of the invention and, together with the description, serve to explain the principles of the invention.

DETAILED DESCRIPTION OF THE PREFERRED EMBODIMENTS

A preferred embodiment of the present invention will now be described in detail in accordance with the accompanying drawings.

Figure 1:
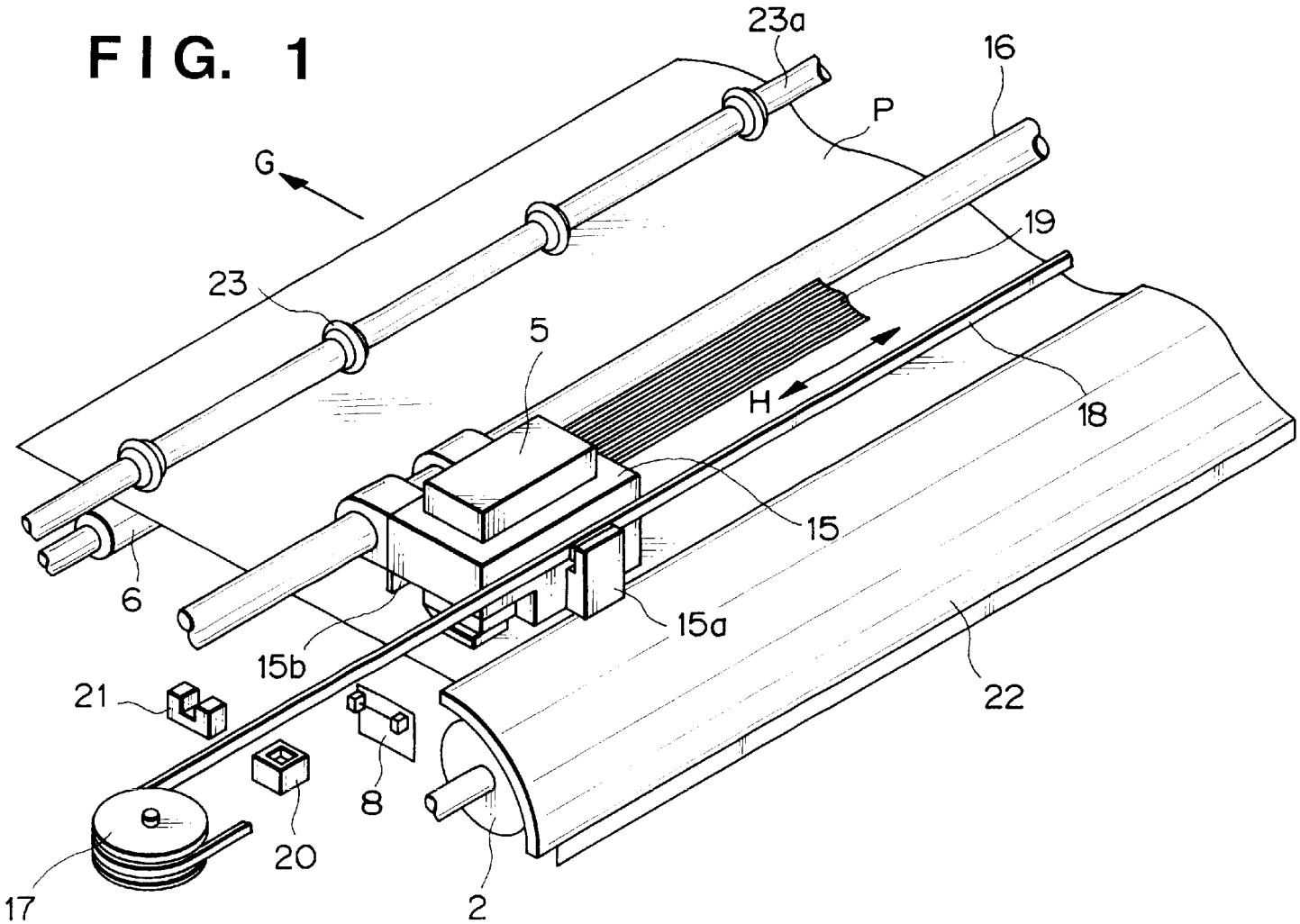
FIG. 1 is a perspective view showing the detailed structure of a printer having a printhead to perform printing in accordance with the ink-jet method, as a typical embodiment of the present invention.

FIG. 1 is a perspective view showing the detailed structure of a printer having a printhead to perform printing in accordance with the ink-jet method, as a typical embodiment of the present invention.

As shown in FIG. 1, a printhead 5, including an ink tank, is a cartridge type printhead which can be exchanged for a new printhead when ink is exhausted.

In FIG. 1, a carriage 15 is reciprocate-scanned in a direction (main-scanning direction represented by the arrow H) orthogonal to a feeding direction (subscanning direction represented by the arrow G) of a print sheet P, while holding the printhead 5 with high precision. The carriage 15 is slidably held between a guide shaft 16 and a thrust member 15*a*. The reciprocation scanning of the carriage 15 is made by a pulley 17 driven by a carriage motor (not shown) and a timing belt 18, and a print signal and electric power, provided to the printhead 5 at this time, are supplied from electric circuits of the apparatus main body via a flexible cable 19. The printhead 5 and the flexible cable 19 are connected by press-contact between their respective contact points.

Further, a cap 20 is provided at a home position of the carriage 15. The cap 20 also functions as an ink reception member. The cap 20 moves upward/downward in accordance with necessity. When the cap 20 moves upward, it comes into close contact with the printhead 5 so as to cover a nozzle portion, preventing evaporation of ink and adhesion of dust to the nozzles.

The apparatus uses a carriage home sensor 21 provided in the apparatus main body and a light shield plate 15*b* provided in the carriage 15 so as to set the printhead 5 and the cap 20 at positions relatively opposite to each other. The carriage home sensor 21 uses a photo-interrupter. The carriage home sensor 21 detects that the printhead 5 and the cap 20 are at relatively opposite positions by utilizing the fact that when the carriage 15 moves to a standby position, light emitted from a part of the carriage home sensor 21 is blocked by the light shield plate 15*b*.

The print sheet P is conveyed upward from the lower side in FIG. 1, then turned in a horizontal direction by a paper feed roller 2 and a paper guide 22, and conveyed in the subscanning direction (the arrow G direction). The paper feed roller 2 and a paper discharge roller 6 are respectively driven by a printing motor (not shown), to convey the print sheet P with high precision in the subscanning direction, in cooperation with the reciprocation scanning of the carriage 15, in accordance with necessity. Further, spurs 23 of highly water-repellent material, each having a toothed circumferential edge to contact the print sheet P only by this portion, are provided in the subscanning direction. The spurs 23 are provided at a plurality of positions opposite to the paper discharge roller 6, at predetermined intervals in the main-scanning direction, on a bearing member 23*a*. Even if the spurs 23 come into contact with an unfixed image on the print sheet P immediately after printing, the spurs 23 guide and convey the print sheet P without influencing the image.

Figure 2:
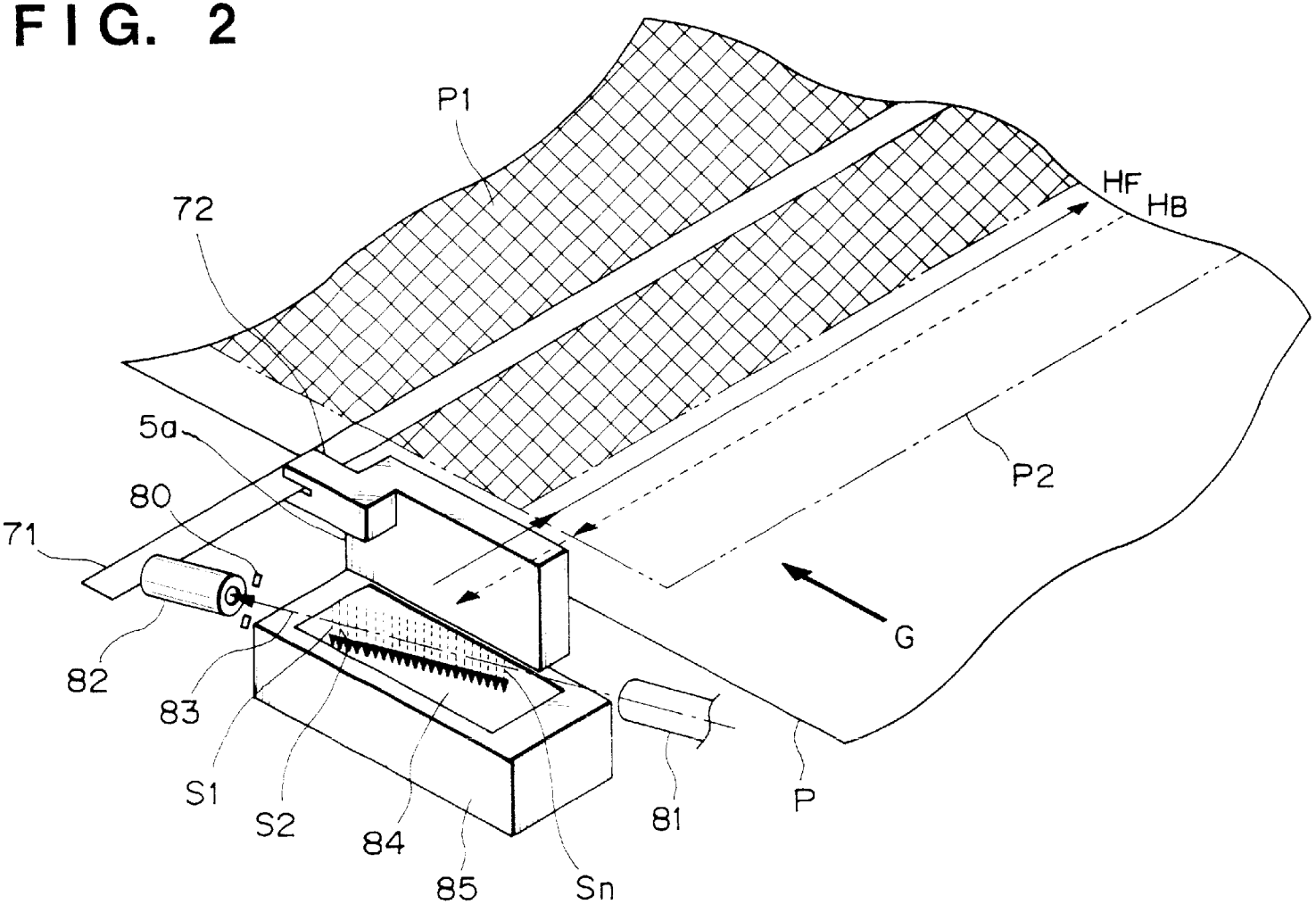
FIG. 2 is an enlarged perspective view showing the detailed structure around a photosensor 8 of the printer in FIG. 1.
Figure 3:
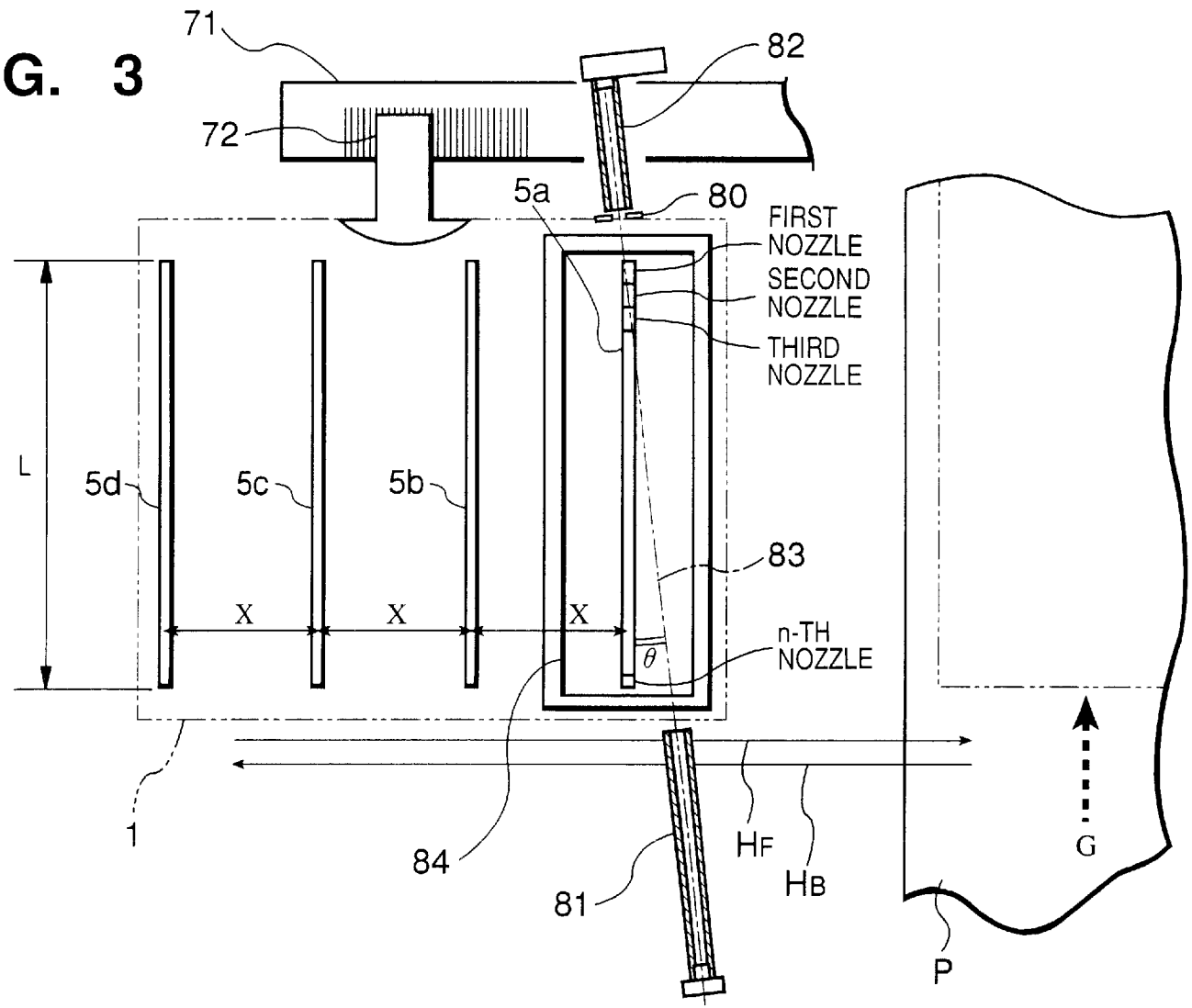
FIG. 3 is an explanatory view showing the positional relation between a nozzle array of a printhead 5 and the photosensor 8.

As shown in FIGS. 2 and 3, the photosensor 8 is provided between the cap 20 and the paper end of the print sheet P at a position opposite to a nozzle array 5*a* of the printhead 5. The photosensor 8 is a photo-interruptive type sensor which optically and directly detects ink droplets discharged from the nozzles of the printhead 5.

FIG. 2 is an enlarged perspective view showing the detailed structure around the photosensor 8 of the printer in FIG. 1.

The photosensor 8 uses an infrared LED as an light emitting device 81. The light emitting device 81 has an LED light emitting surface integrally formed with a lens, and it projects an approximately collimated light beam toward a photoreception device 82. The photoreception device 82 comprises a photo-transistor, and it has a hole of, e.g., about 0.7 mm×0.7 mm, formed by a molded member 80, in front of the photoreception surface, on its optical axis, to limit the detection range within the entire region between the photoreception device 81 and the light emitting device 82 to 0.7 mm in the height direction and 0.7 mm in the width direction.

Since the size of the ink droplet is equal to or less than 1/10 of the diameter of the light flux of the light beam and the diameter of the sensor, and the change amount in the quantity of light obtained by the sensor is small, the detection range is limited by the pin hole formed by the molded member 80, so that the ratio (S/N ratio) between the quantity of light obtained when the ink droplet exists within the range and that obtained when no ink droplet exists in the light flux can be increased, and detection precision can be increased.

Further, a light axis 83 connecting the light emitting device 81 to the photoreception device 82 is arranged so as to intersect the nozzle array 5*c* of the printhead 5 at an angle θ, and the interval between the light emitting device 81 and the photoreception device 82 is wider than the length of the nozzle array 5*c* of the printhead 5. When an ink droplet passes through the detection range, the ink droplet blocks light from the light emitting side, thus reduces the quantity of light to the photoreception side, which changes output from the phototransistor as the photoreception device 82.

Note that the means for limiting the detection range and the shape of the means are not necessarily the pin hole of molded member, but a slit or the like may be used.

The printer performs normal printing when the printhead moves in a forward direction represented by the arrow $H_F$, in the reciprocation scanning of the printhead, and when the printhead moves in a backward direction represented by the arrow $H_B$, performs complementary printing to complement an unprinted image portion caused by a defective nozzle.

In FIG. 2, reference numeral P1 denotes an area where printing has been already performed; P2, an area where printing is to be performed; S1, S2 and Sn, falling trajectory of ink droplets discharged from the printhead; 71, a scale attached in parallel to a moving direction of the printhead 5; and 72, a linear encoder attached to the printhead 5.

The linear encoder 72 detects the position of the printhead 5 by reading a graduation line of the scale 71 while the printhead 5 moves. The detected position is utilized as a reference for image printing and as reference information for defective nozzle detection to be described later.

Further, a member 84, which receives ink droplets discharged for the defective nozzle detection, is attached to a support base 85. Although not shown, small amount of cleaning water is intermittently poured into the member 84, and ink is discharged by a suction pump (not shown) with the water.

Note that as the number of nozzles of the printhead increases, ink droplets must be detected in a stable manner for a long period. Accordingly, it is advantageous that the light source of the photosensor has a high directionality to easily limit the light flux. Accordingly, in addition to the above-described infrared light from the LED, semiconductor laser or other laser light sources may be used. Further, ink droplets are sequentially discharged from the printhead, in one-nozzle units, at short discharge periods of 200 μm or less. Accordingly, it is preferable that the photosensor 8 is a high-speed response device such as a PIN silicon photodiode. Further, the output from the light source may be controlled in correspondence with the characteristic (e.g., the absolute rating of incident light intensity) of the photosensor 8. For example, the quantity of light from the light source may be controlled by using an ND filter or the like.

FIG. 3 is an explanatory view showing the positional relation between the nozzle array of the printhead 5 and the photosensor 8. Especially, this figure shows the relative positional relation between the position of the printhead upon ink-discharge status detection and the light axis of the light beam for the detection, as a figure viewed from a position above the printhead 5. As it is apparent from FIG. 3, the light beam passes at a predetermined angle (θ) through the direction along the nozzle array (5*a* in FIG. 3) of the printhead 5.

In use of a color printhead as shown in FIG. 3, nozzle arrays 5*a* to 5*d*, respectively to discharge ink of four colors, black, cyan, magenta and yellow, are provided in parallel to each other corresponding to the respective colors. In this arrangement, to avoid interference by photosensor output signals obtained from the adjacent nozzle arrays, the interval (X) between heads, the head length (L) (effective printing length), and the angle (θ) between the axis of light beam and the nozzle array must satisfy the following relation:

$$L \times \tan\theta < X$$

If the above relation is not satisfied, before defective nozzle detection with respect to one nozzle array is completed, ink droplets discharged from the next nozzle array pass the light, whereby the correspondence between the defective nozzle determination and nozzle array of interest cannot be discriminated.

In the present embodiment, as the nozzle arrays are slanted at the angle θ to the light axis of the photosensor, the photosensor can detect the discharge status of each nozzle. Further, even in case of a color printhead having a plurality of nozzle arrays, since the interval between nozzles is determined in consideration of the angle (θ), the photosensor can detect the ink discharge status of each nozzle of each nozzle array.

On this condition, when the printhead 5 discharges ink droplets sequentially from the first nozzle, second nozzle, the third nozzle, . . . , while moving in the arrow $H_F$ direction, the photoreception device 82 receives light beam blocked by the ink droplets. Similarly, the ink-droplet detection operation is performed with respect to the other nozzle arrays 5*b* to 5*d*.

Figure 4:
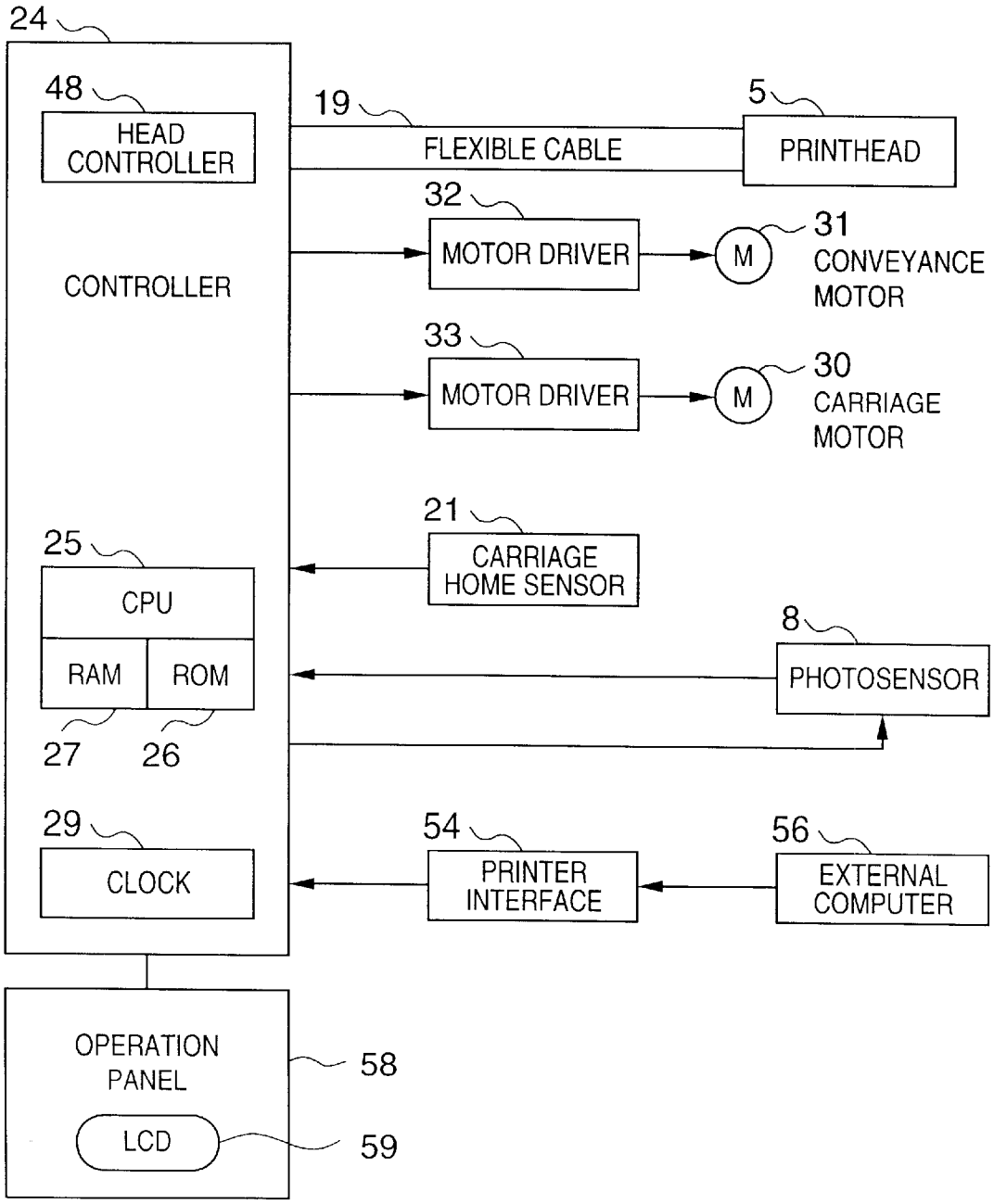
FIG. 4 is a block diagram showing the control construction of the printer in FIG. 1.

FIG. 4 is a block diagram showing the control construction of the printer in FIG. 1.

In FIG. 4, numeral 24 denotes a controller for controlling the overall apparatus. The controller 24 has a CPU 25, a ROM 26 in which a control program executed by the CPU 25 and various data are stored, a RAM 27 used by the CPU 25 as a work area for executing various processings or used for temporarily storing various data, a head controller 48 for controlling the print operation of the printhead 5, and the like.

As shown in FIG. 4, the printhead 5 is connected to the controller 24 via the flexible cable 19. The flexible cable 19 includes a control signal line for the controller 24 to control the printhead 5, and an image signal line. Further, the output from the photosensor 8 is transferred to the controller 24, and analyzed by the CPU 25 via the head controller 48. A carriage motor 30 rotates in accordance with the number of pulse steps by a motor driver 32. Further, the controller 24 controls the carriage motor 30 via a motor driver 33, and controls a conveyance motor 31 via the motor driver 32, further, inputs the output from the carriage home sensor 21.

Further, the controller 24 has a printer interface 54 which receives a print instruction and print data from an external computer 56. Further, the controller 24 is connected to an operation panel 58 for a user of the apparatus to perform various operations and instructions. The operation panel 58 has an LCD 59 to display a message.

Figure 5:
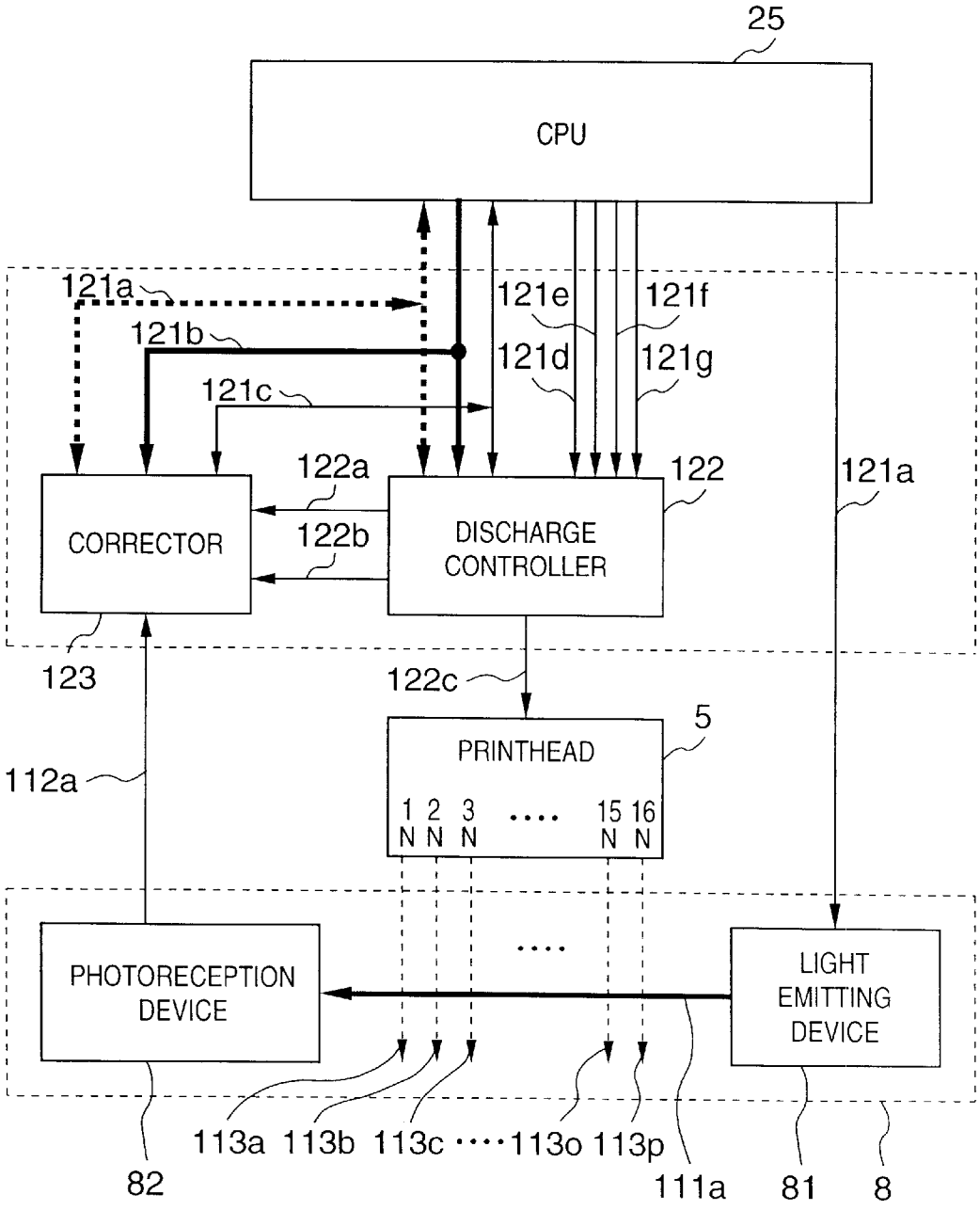
FIG. 5 is a block diagram showing the construction of a head controller 48 and the construction of the photosensor 8 relating to the operation of the head controller 48.

FIG. 5 is a block diagram showing the construction of the head controller 48 and the construction of the photosensor 8 relating to the operation of the head controller 48.

As shown in FIG. 5, the head controller 48 comprises a discharge controller 122 and a corrector 123.

The CPU 25 sequentially transfers image data, sent from the external computer 56 and temporarily stored in the RAM 27 or prepared in the ROM 26 in advance, to the discharge controller 122, in accordance with the print operation control of the printer. The transfer signal includes a BVE* signal (121*d*) indicating an effective image area in the scanning direction of the printhead 5 which performs printing by a serial-scan method, a VE* signal (121*e*) indicating an effective image area in the direction along the nozzle array 5*a* of the printhead 5, an image signal (121*f*), and a transfer synchronizing clock (121*g*) for the image signal 121*f*. These four signals are generally referred to as an image control signal. The image control signal is generated based on a reference signal from the linear encoder 72 that monitors the position of the printhead 5, and used for controlling correspondence between data and its print position.

Further, the discharge controller 122 and the corrector 123 are interconnected and connected to the CPU 25 via a CPU data bus 121*a*, a CPU address bus 121*b* and a CPU control bus 121*c*. Bus control signals transmitted/received via the CPU control bus 121*c* include a device chip select signal, bus read/write signals, a bus direction signal and the like. Note that the CPU data bus 121*a*, the CPU address bus 121*b* and the CPU control bus 121*c* may be generally referred to as a CPU bus.

Further, the CPU 25 outputs a light-emission control signal 121*a* to the light emitting device 81 of the photosensor 8 so as to turn the light source ON/OFF.

The discharge controller 122 generates a head control signal (122*c*) consisting of four types of signals necessary for operating the printhead 5, in accordance with image control signals (121*d* to 121*g*) supplied from the CPU 25 via the CPU bus. Further, the discharge controller 122 outputs a correction synchronizing clock (122*a*) and a discharge synchronizing signal (122*b*) synchronized with the VE* signal (121*e*), to the corrector 123.

The corrector 123 receives a detection signal 112*a* outputted from the photoreception device 82, then increases the S/N ratio, then detects the ink discharge status of the nozzles of the printhead 5 with high precision, in synchronization with the correction synchronizing clock 122*a* and the discharge synchronizing signal 122*b* supplied from the discharge controller 122, and transfers detection data to the CPU 25 via the CPU bus, in accordance with access timing from the CPU 25.

A light beam 111*a* emitted from the light emitting device 81 toward the photoreception device 82 is blocked by ink droplets (113*a* to 113*p*) sequentially discharged from the nozzles (1N to 16N in FIG. 5) of the printhead 5. The light blocking is detected by the reduction of intensity of received light at the photoreception device 82, and the ink discharge statuses of the respective nozzles are determined based on information obtained from the detection.

Figure 6:
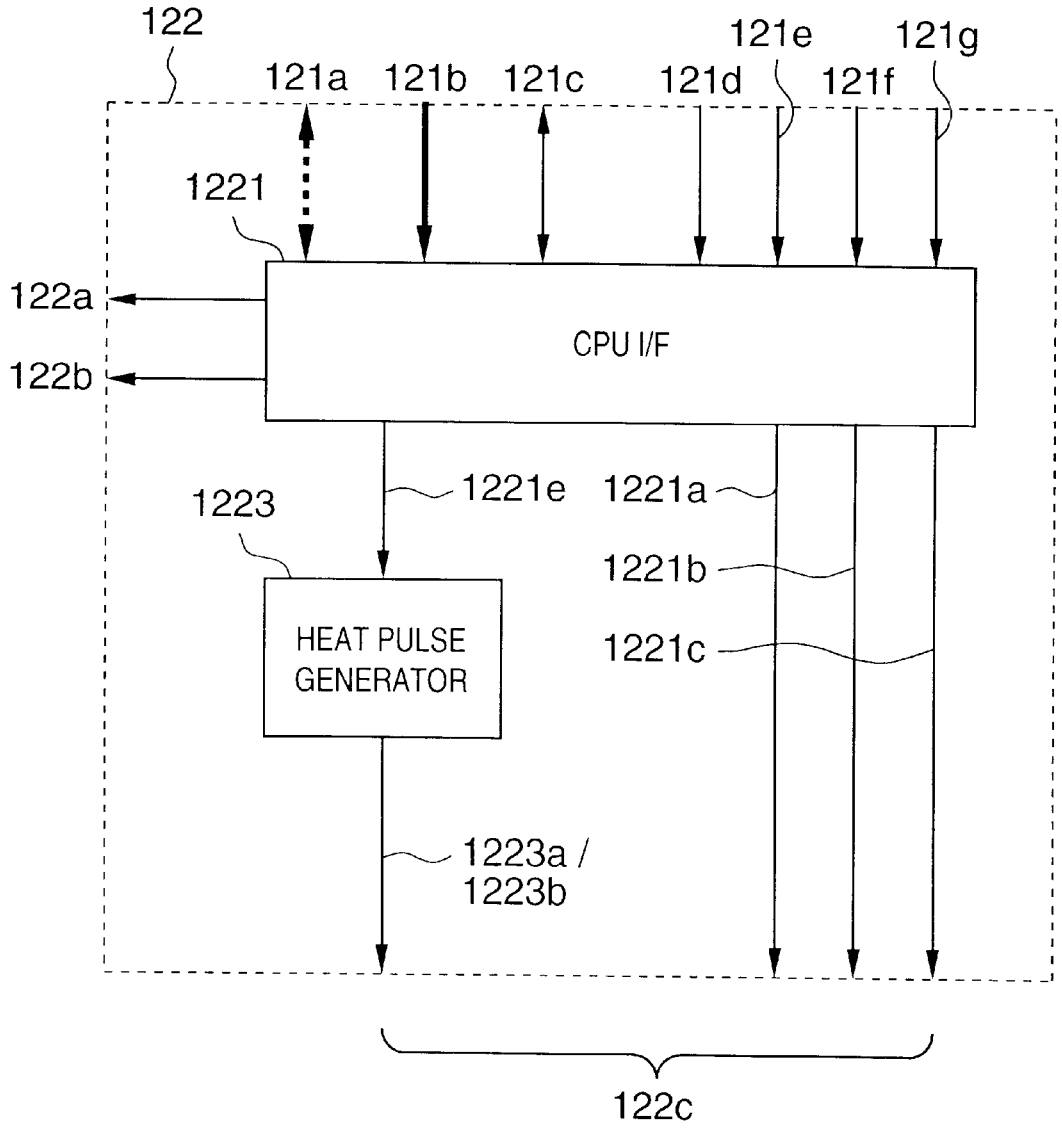
FIG. 6 is a block diagram showing the construction of a discharge controller 122.

FIG. 6 is a block diagram showing the internal construction of the discharge controller 122.

As shown in FIG. 6, the discharge controller 122 comprises a CPU interface (I/F) 1221 and a heat pulse generator 1223. The heat pulse generator 1223 generates a control signal used by the printhead 5 upon printing using image data. On the other hand, the CPU interface 1221, connected to the CPU 25 via the CPU bus, performs settings necessary for discharge controls (1) to (4) to be described later, generates an image transfer signal supplied to the printhead 5, and generates a control signal supplied to the corrector 123.

The settings necessary for discharge controls and signal generation are as follows.

(1) Setting of heat pulse to heat pulse generator (1223)

A double pulse as the heat pulse upon execution of normal print operation is set by a setting signal (1221*e*). The set heat pulse width is a pulse width in a discharge enable area.

(2) Generation of data transfer signal (1221*a* to 1221*c*) to Printhead 5 Based on Image Control Signal (121*d* to 121*g*) Supplied from CPU 25.

The data transfer signal (1221*a* to 1221*c*) are generated based on the reference signal from the linear encoder 72 that detects the position of the printhead 5, and used for controlling correspondence between data and its print position.

More specifically, the data transfer signal 1221*a* is an image signal corresponding to all the nozzles (for 16 nozzles in FIG. 5); the data transfer signal 1221*b*, a synchronizing clock; and the data transfer signal 1221*c*, a latch signal. More specifically, the signals are generated such that the image signal 1221*a* is transferred to a shift register (not shown) in the printhead 5, at the rising edge of the synchronizing clock 1221*b*, then the latch signal 1221*c* is transferred to the printhead 5, and the image signal 1221*a* is latched by a latch circuit (not shown) in the printhead 5. Note that actual ink discharge is performed by a discharge pulse signal (1223*a* or 1223*b*) supplied from the heat pulse generator 1223.

(3) Generation of clock signal 112*a* supplied to corrector 123

This signal is a clock signal, asynchronous with the image transfer clock 1221*b*, having a frequency four times of that of the image transfer clock 1221*b*.

(4) Generation of VE* signal 122*b* supplied to corrector 123

This synchronizing signal, synchronous with the VE* signal (121*e*), is outputted at the same timing as that of the discharge pulse signal.

Figure 7:
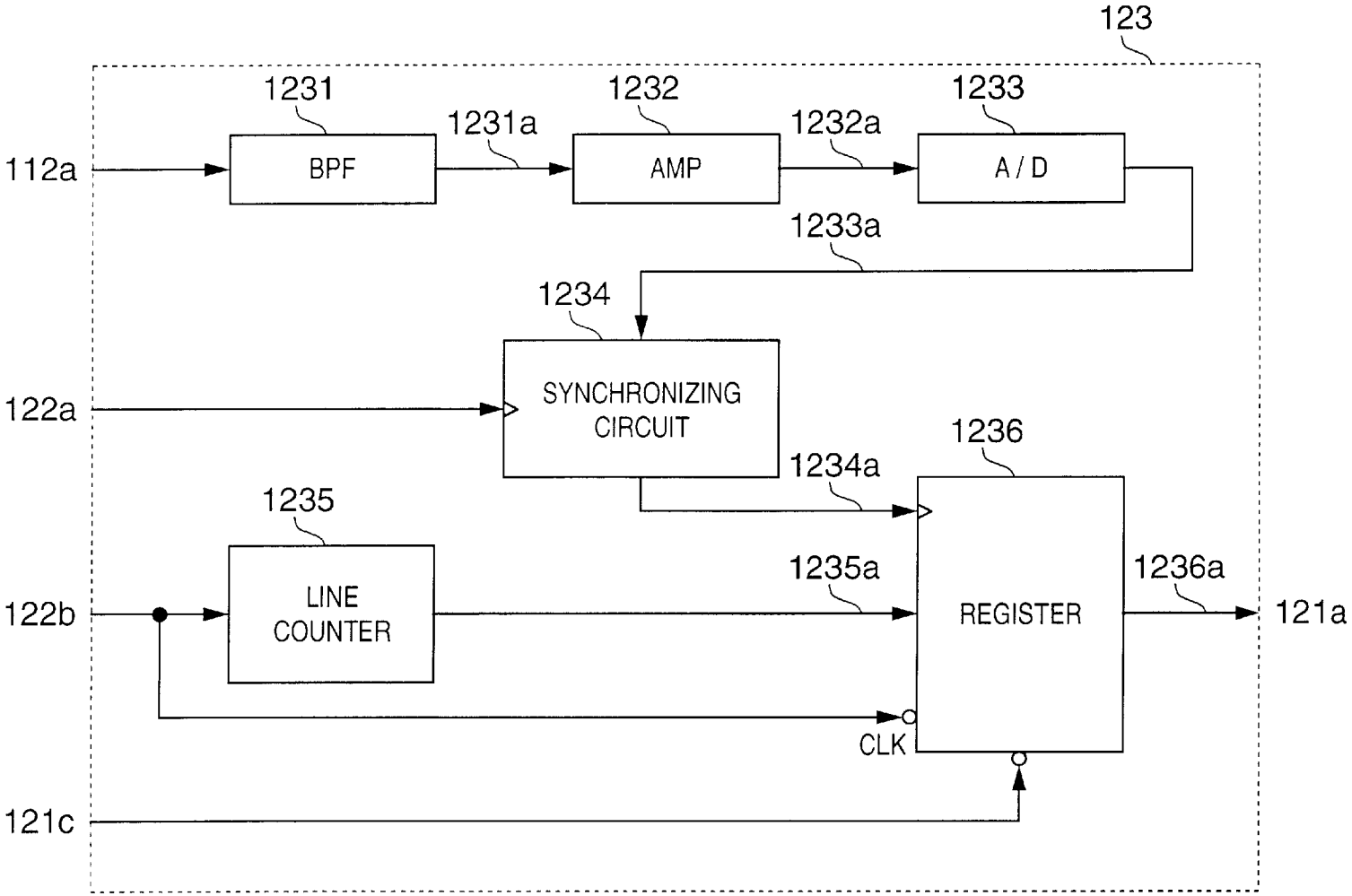
FIG. 7 is a block diagram showing the internal construction of a corrector 123.
Figure 8:
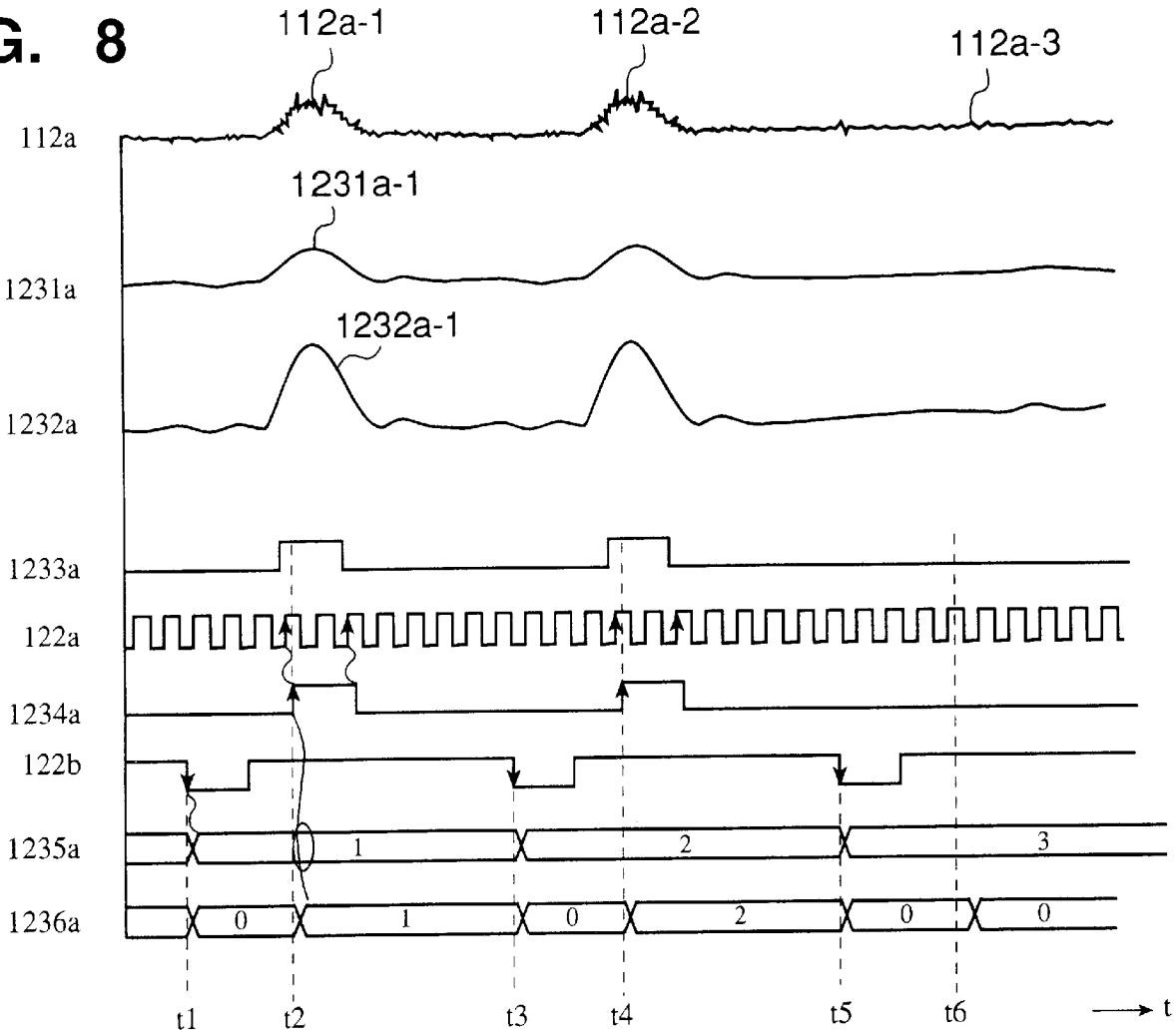
FIG. 8 is a timing chart showing various signal timings when a detection signal obtained from the photosensor 8 is processed by the corrector 123.

FIG. 7 is a block diagram showing the internal construction of the corrector 123. FIG. 8 is a timing chart showing various signal timings when a detection signal obtained from the photosensor 8 is processed by the corrector 123. Hereinbelow, the operation of the corrector 123 will be described with reference to FIGS. 7 and 8.

In FIG. 7, a band-pass filter (BPF) 1231, which is a filter to improve the S/N ratio of the detection signal (112*a*) obtained from the output from the photoreception device 82, extracts a characteristic waveform (1231*a*: hereinafter referred to as a filtered signal) from the detection signal 112*a*. The detection signal 112*a* indicates whether or not ink is normally discharged sequentially from the first nozzle of the pinhead 5. If ink is normally discharged from all the n nozzles of the printhead 5, a signal having peaks at predetermined periods is outputted. In the detection signal 112*a* in FIG. 8, numeral 112*a*-1 denotes a detection signal relating to ink-droplet discharge from the first nozzle; 112*a*-2, a detection signal relating to ink-droplet discharge from the second nozzle; 112*a*-3, a detection signal relating to ink-droplet discharge from the third nozzle. Similarly, detection signals are outputted until a signal corresponding to the n-th nozzle is outputted. Note that FIG. 8 shows the ink discharge statuses of the first to third nozzles. This figure shows statuses indicating that ink is normally discharged from the first and second nozzles (discharge statuses) and a status indicating that ink is not discharged from the third nozzle (discharge failure status).

As shown in FIG. 8, as the detection signal 112*a* includes a noise component, the filtered signal (1231*a*) is generated by removing the noise component through the band-pass filter 1231. By this arrangement, for example, the detection signal 112*a*-1 relating to the ink-droplet discharge from the first nozzle becomes a filtered signal where a high frequency noise component is removed as a signal 1231*a*-1 in FIG. 8.

However, as the extracted characteristic waveform (1231*a*) is a weak signal with a low voltage level, it is not appropriate for the processing by the CPU 25. Accordingly, an amplifier (AMP) 1232 amplifies the filtered signal (1231*a*), and as shown in FIG. 8, the amplifier 1232 outputs the amplified signal (1232*a*). Then, an A/D converter 1233 converts the amplified signal into a digital signal (1233*a*).

The digital detection signal (1233*a*) is inputted into a synchronizing circuit 1234. To remove a noise signal such as spike noise unnecessary for signal processing, the signal is shaped based on the clock signal (122*a*) supplied from the discharge controller 122 as shown in FIG. 8. The shaped detection signal (1234*a*) without noise component is inputted into a latch clock of a register 1236.

On the other hand, a count signal (1235*a*), as output from a line counter 1235 which counts the order of ink discharge, is inputted into the register 1236, and the register 1236 is set to the input value. The set register data is outputted to the CPU 25 via the CPU data bus 121*a*, in accordance with the control signal supplied from the CPU 25 via the CPU control bus 121*c*. The set value of the register 1236 is cleared upon each discharge by a discharge count signal (122*b*).

Accordingly, when an ink droplet is discharged, the register 1236 outputs discharge detection data (1236*a*) indicating a nozzle number, while if ink discharge failure is detected, the register 1236 outputs the discharge detection data (1236*a*) having a value "0".

Next, actual ink droplet detection will be described in order with reference to the timing chart of FIG. 8.

(1) time t=t1

When the discharge count signal (122*b*) is inputted into the line counter 1235, and the count value of the count signal (1235*a*) is incremented to "1". At the same time, the discharge count signal (122*b*) is also inputted into a clear terminal (CLR) of the register 1236, and the value of the discharge detection data (1236*a*) is cleared to "0".

(2) time t=t2

As the rising of the detection signal (1234*a*) indicates that an ink droplet from the first nozzle of the printhead 5 has been detected, the value "1" of the count signal (1235*a*) is latched by the register 1236. The value of the latched discharge detection data (1236*a*) changes from "0" to "1" at this timing, and the detection of ink droplet from the first nozzle is notified via the CPU data bus 121*a* to the CPU 25.

(3) time t=t3

The count value of the line counter 1235 is incremented by the discharge count signal (122*b*), and the value of the count signal 1235*a* is changed to "2". At the same time, the value of the discharge detection data (1236*a*) of the register 1236 is cleared to "0".

(4) time t=t4

As the next rising of the detection signal (1234*a*) indicates that an ink droplet from the second nozzle of the printhead 5 has been detected, the value "2" of the count signal (1235*a*) is latched by the register 1236. The value of the latched discharge detection data (1236*a*) changes from "0" to "2" at this timing, and the detection of ink droplet from the second nozzle is notified via the CPU data bus 121*a* to the CPU 25.

(5) time t=t5

The count value of the line counter 1235 is incremented by the discharge count signal (122*b*), and the value of the count signal (1235*a*) is changed to "3". At the same time, the discharge detection data (1236*a*) of the register 1236 is cleared to "0".

(6) time t=t6

At this timing, the detection signal (1234*a*) does not indicate ink-droplet detection status, and there is no rising edge in the pulse signal. Therefore, the value "3" of the count signal (1235*a*) cannot be latched by the register 1236. Accordingly, the value of the discharge detection data (1236*a*) as latch data is "0" and it does not change. The status where an ink droplet from the third nozzle has not been detected, i.e., discharge failure status is notified via the CPU data bus 121*a* to the CPU 25.

By the processing as described above, the printer of the present embodiment notifies the CPU 25 of ink discharge status of each nozzle in an approximately real time manner. Further, as the photosensor 8 is provided between the home position of the printhead 5 and the effective printing area, it can detect ink discharge status while the printhead is reciprocate-scanned without specific printhead-moving control.

Next, the operation of the ink-discharge status detection in the printer having the above construction will be described. Note that in the following description, for simplification of explanation, the printhead 5 has one nozzle array having 16 nozzles. In the present embodiment, the ink-discharge status detection can be performed upon forward scanning and backward scanning of the printhead.

(1) Ink-discharge status detection upon forward scanning

Figure 9:
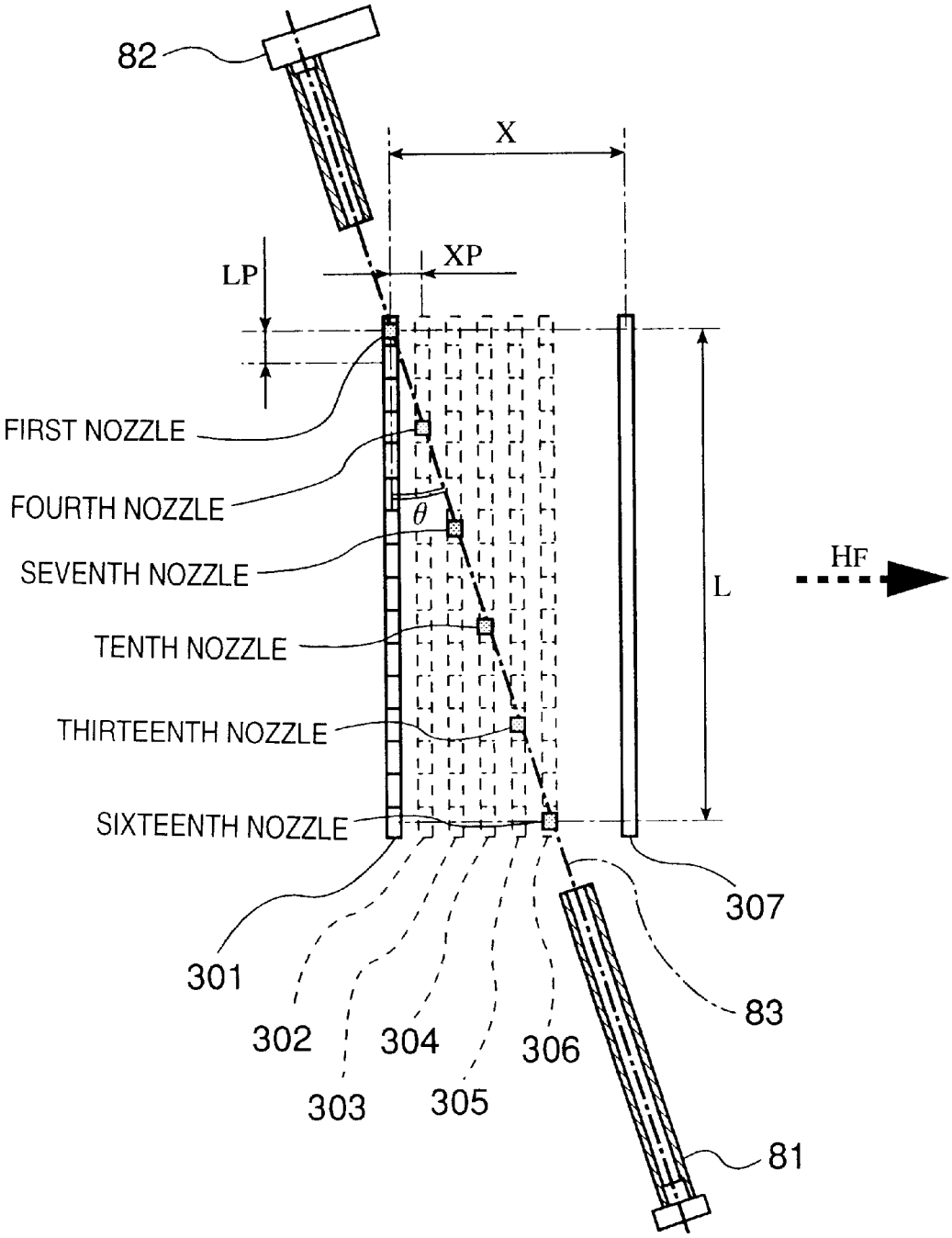
FIG. 9 is an explanatory view showing the operation of ink-discharge status detection upon forward scanning in which a carriage 15 is moved in a direction represented by an arrow $H_F$.

FIG. 9 is an explanatory view showing the operation of ink-discharge status detection upon forward scanning in which the carriage 15 is moved in the arrow $H_F$ direction.

In FIG. 9, hatched small cells represent ink droplets discharged from the first nozzle, the fourth nozzle, the seventh nozzle, the tenth nozzle, the thirteenth nozzle, and the sixteenth nozzle, or ink discharge positions of the ink droplets on the member 84. Alphabet "L" denotes the head length (effective printing length: actually, the distance between the first nozzle and the final nozzle in the printhead); "X", the interval between the heads; "LP", a pitch between adjacent nozzles; "XP", a pitch between adjacent print dots in a carriage moving direction.

In the present embodiment, the pitch between adjacent print dots (XP), corresponding to the printing resolution of the printer, i.e., 360 dpi, has a uniform value of 70.5 μm between respective print dots. Also, the pitch between adjacent nozzles (LP) from the first nozzle to the sixteenth nozzle has a uniform value of 70.5 μm. The angle (θ) of the light beam limited by the interval (X) between adjacent heads with respect to the nozzle array is about 18.4°.

On the above conditions, the printhead 5 discharges ink from the first nozzle at a position 301, when the printhead 5 moves in the arrow $H_F$ direction. At this time, the discharge position of the ink droplet discharged from the first nozzle (1N) is controlled such that the ink droplet passes the light axis 83 of the light beam. Further, the printhead 5 moves in the arrow $H_F$ direction, next, discharges ink from the fourth nozzle (4N) at a position 302. At this time, the discharge position of the ink droplet discharged from the fourth nozzle (4N) is controlled such that the ink droplet passes the light axis 83 of the light beam.

Hereinafter, similarly, when the printhead 5 moves in the arrow $H_F$ direction, the printhead 5 discharges ink sequentially from the seventh nozzle, the tenth nozzle, the thirteenth nozzle and the sixteenth nozzle, at positions 303, 304, 305 and 306.

In this manner, ink discharge is performed from the six nozzles in correspondence with the movement of the printhead 5, and information on the respective discharge statuses are obtained from outputs from the photoreception device 82. When the printhead 5 further moves in the arrow $H_F$ direction to a position 307, similar ink discharge operation is performed by an adjacent nozzle array. In this manner, the ink-discharge statuses from the nozzles are detected while the printhead 5 moves in the arrow $H_F$ direction.

Note that upon ink-discharge status detection, the interval (Y) between discharge nozzles is limited to be three nozzles due to the moving speed of the carriage 15. In the present embodiment, upon actual printing on the print sheet P, the moving speed (V) of the carriage 15 is 400 mm/s, and the ink-droplet discharge period (T) from the printhead 5 is 176 μsec. The ink-discharge status detection is performed without changing the actual printing conditions, and therefore, the condition of the above nozzle interval must be satisfied.

Assuming that the total number of the nozzles in the nozzle array of the printhead is N, the interval (Y) between discharge nozzles, the angle (θ) between the nozzle array and the light beam, and the effective printing length (L) are generally represented by the following equations:

$$Y=INT\{[N\div INT(X\div(V\times T))]+1\} \quad (1)$$

$$\theta=1/Y\leqq(X-XP)/L \quad (2)$$

$$L=(N-1)P \quad (3)$$

FIG. 9 shows an example where Y=3 holds as the interval (Y) between discharge nozzles. In this case, the printhead 5 performs ink discharge operation when the printhead 5 passes the light axis 83 thrice, thus the ink-discharge statuses of all the 16 nozzles can be detected.

Figure 10:
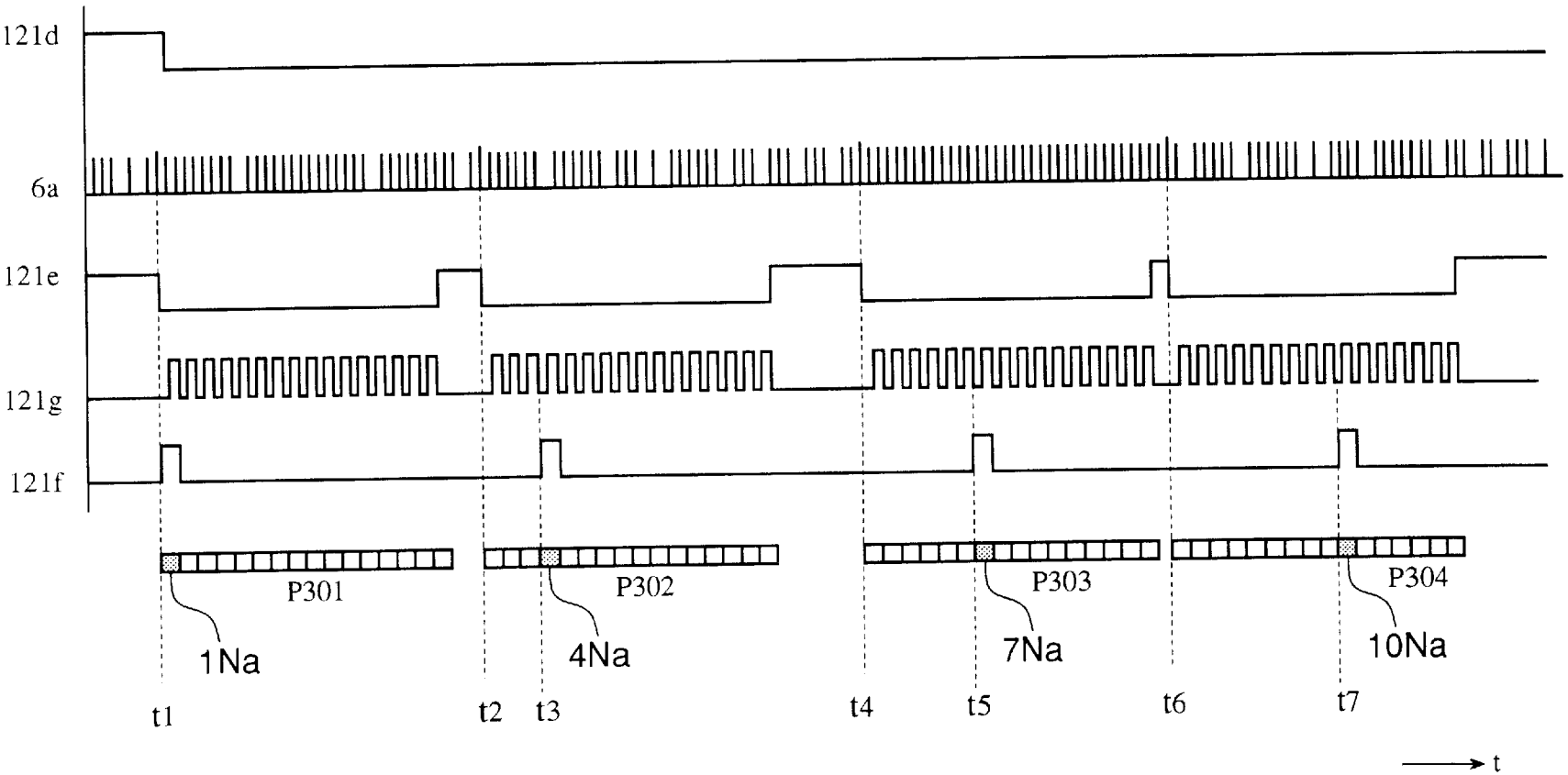
FIG. 10 is a timing chart showing various control signal timings in the ink-discharge status detection upon forward scanning corresponding to FIG. 9.

FIG. 10 is a timing chart showing various control signal timings in the ink-discharge status detection upon forward scanning corresponding to FIG. 9.

In FIG. 10, numerals 121*d* to 121*g* denotes the image control signals outputted from the CPU 25 to the discharge controller 122, as described with reference to FIGS. 5 and 6; 6*a*, a reference signal from the linear encoder 72, as a reference for generating the image control signals; P301 to P304, ink discharge timings respectively corresponding to the positions 301 to 304 in FIG. 9, representing nozzle positions to discharge ink by the control signals on the timing chart; 1Na, the first nozzle; 4Na, the fourth nozzle; 7Na, the seventh nozzle; and 10Na, the tenth nozzle.

Referring to FIG. 10, when the reference signal (6*a*) from the linear encoder 72 is outputted for a predetermined number of pulses (e.g., 34 pulses), at time t=t1, the BVE* signal (121*d*) becomes active (low level), and the ink-discharge status detection is started at the position 301. At the same time, the VE* signal (121*e*) of the nozzle array 5*a* of the printhead 5 becomes active (low level), then the image signal (121*f*) corresponding to the first nozzle is transferred with the image transfer synchronizing clock (121*g*), and the first nozzle (1Na) discharges ink at the position 301. Next, at time t=t2 where the number of pulses of the reference signal (6*a*) from the time t=t1 becomes "34", the ink-discharge status detection is started at the position 302.

In this case, similarly to the ink-discharge status detection at the position 301, the VE* signal (121*e*) of the nozzle array 5*a* of the printhead 5 becomes active (low level), then the image signal (121*f*) corresponding to the fourth nozzle is transferred with the image transfer synchronizing clock (121*g*), and the fourth nozzle (4Na) discharges ink at time t=t3 at the position 302.

Similarly, at time t=t3 where the number of pulses of the reference signal (6*a*) from the time t=t2 becomes "34", the ink-discharge status detection is started at the position 303. At the position 303, the seventh nozzle (7Na) discharges ink at time t=t5. Further, at time t=t6 where the number of pulses of the reference signal (6*a*) from the time t=t4 becomes "34", the ink-discharge status detection is started at the position 304. At the position 304, the tenth nozzle (10Na) discharges ink at time t=t7.

In this manner, as it is apparent from FIG. 10, the ink-discharge operation is performed each time the reference signal (6*a*) from the linear encoder 72 has been counted for a predetermined number. This arrangement prevents fluctuation of ink discharge position of the carriage 15 due to unevenness of rotation of the carriage motor 30 or the like.

Figure 11:
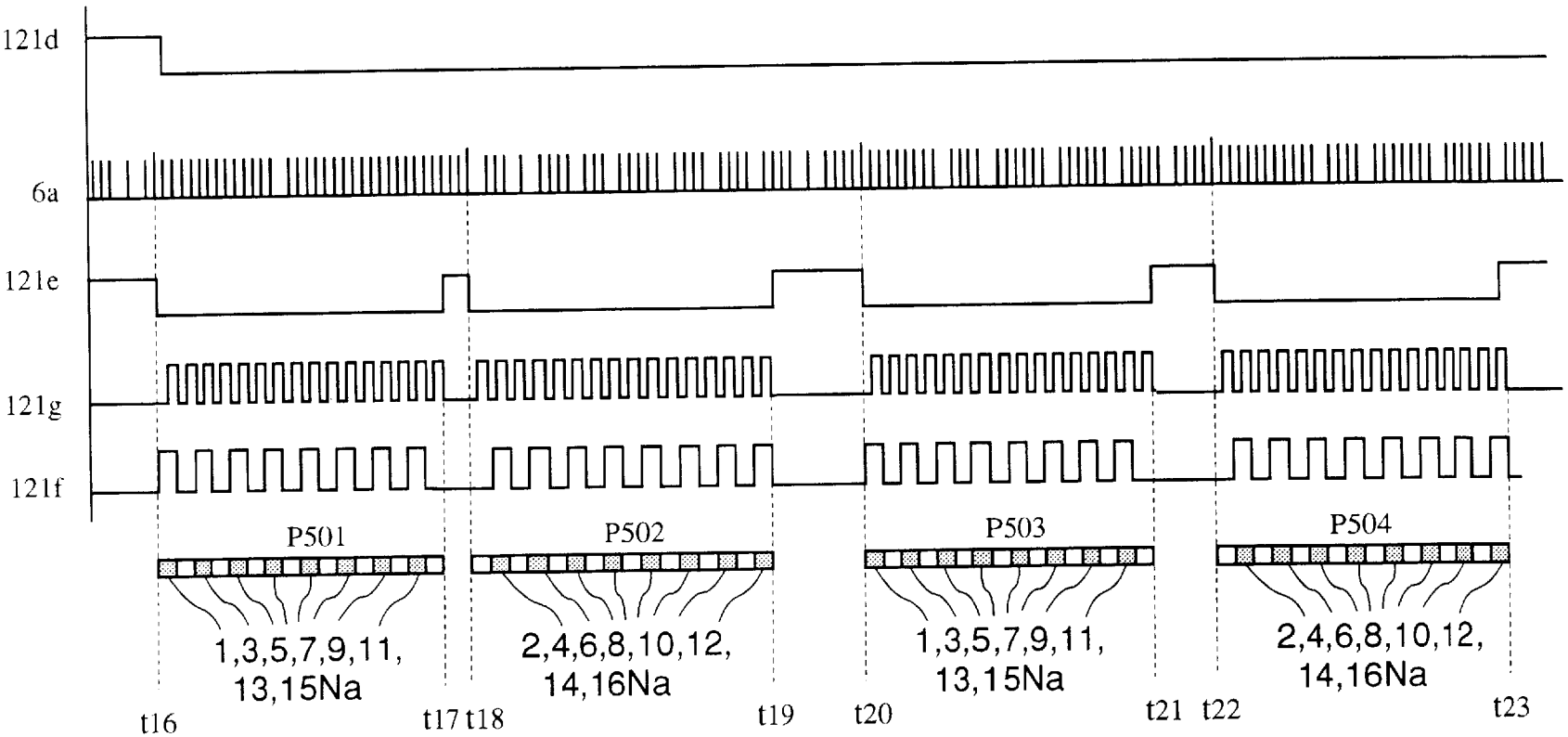
FIG. 11 is a timing chart showing various control signal timings to perform normal print operation upon forward scanning.

FIG. 11 is a timing chart showing various control signal timings to perform normal print operation upon forward scanning.

In FIG. 11, numerals P501 to P504 denote ink discharge timings on the timing chart corresponding to the four positions within the effective printing area on the forward scanning path of the printhead 5, and represent nozzle positions to discharge ink by the control signals on the timing chart. Numerals 1Na to 16Na denote the first to sixteenth nozzle. Note that the positions P501 and P502, the positions P502 and P503, and the positions P503 and P504 are away from each other by the interval (X) between adjacent heads.

As it is apparent from FIG. 11, in normal print operation, ink is discharged from odd numbered nozzles at the positions P501 and P503, and from even numbered nozzles at the positions P502 and P504. This forms a checkered dot pattern, formed with dots discharged from every other nozzle, on the print sheet P.

Referring to FIG. 11, when the reference signal (6*a*) from the linear encoder 72 has been counted for a predetermined number of pulses (34 pulses), the BVE* signal (121*d*) becomes active (low level) at time t=t16, and the ink discharge operation is started at the position P501. At the same time, the VE* signal (121*e*) of the nozzle array 5*a* of the printhead 5 becomes active (low level), then the image signal (121*f*) corresponding to the first nozzle, the third nozzle, the fifth nozzle, the seventh nozzle, the ninth nozzle, the eleventh nozzle, the thirteenth nozzle and the fifteenth nozzle is transferred in accordance with the image transfer synchronizing clock (121*g*) from the time t=t16 to t=t17, and ink is discharged from the respective nozzles at the position P501 in accordance with the image signal (121*f*). Next, at time t=t18 where the number of pulses of the reference signal (6*a*) from the time t=t16 becomes "34", the ink discharge operation is started at the position P502.

At this time, similarly to the ink discharge at the position P501, the VE* signal of the nozzle array 5*a* of the printhead 5 becomes active (low level), then the image signal (121*f*) corresponding to the second nozzle, the fourth nozzle, the sixth nozzle, the eighth nozzle, the tenth nozzle, the twelfth nozzle, the fourteenth nozzle, and the sixteenth nozzle is transferred in accordance with the image transfer synchronizing clock (121*g*) from the time t=t18 to t=t19, and ink is discharged from the respective nozzles at the position P502 in accordance with the image signal (121*f*).

Hereinafter, similarly, at time t=t20 where the number of pulses of the reference signal (6*a*) from the time t=t18 becomes "34", the ink discharge operation is started at the position P503. At the position P503, the odd numbered nozzles discharge ink from time t=t20 to t=t21, in accordance with the image signal (121*f*). Further, at time t=t22 where the number of pulses of the reference signal (6*a*) from the time t=t20 becomes "34", the ink discharge operation is started at the position P504. At the position P504, the even numbered nozzles discharge ink from time t=t22 to t=t23 in accordance with the image signal (121*f*).

In this manner, as apparent from FIG. 11, the ink-discharge operation is performed each time the reference signal (6*a*) from the linear encoder 72 has been counted for a predetermined number. This arrangement prevents fluctuation of ink discharge position of the carriage 15 due to unevenness of rotation of the carriage motor 30 or the like.

In comparison between the discharge operation sequence as shown in FIG. 10 and that as shown in FIG. 11, the same control is performed in both sequences except that the image signal (121*f*) differs in the respective sequences.

As described above, in the present embodiment, the operation sequence of the print control in the ink-discharge status detection can be performed as operation common to the normal print operation.

(2) Ink-discharge status detection upon backward scanning

Figure 12:
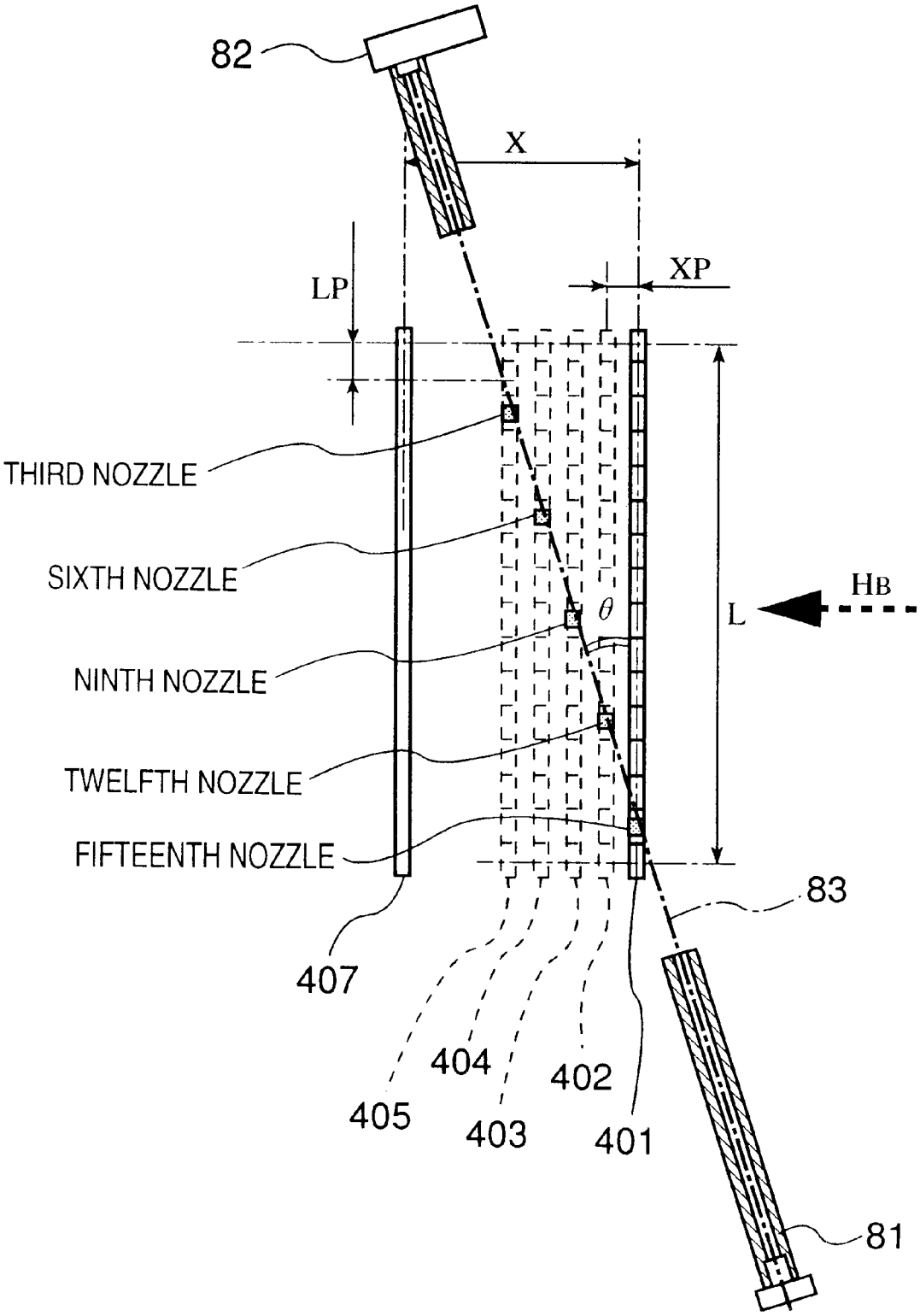
FIG. 12 is an explanatory view showing the operation of the ink-discharge status detection upon backward scanning in which the carriage 15 is moved in a direction represented by an arrow $H_B$.

FIG. 12 is an explanatory view showing the operation of the ink-discharge status detection upon backward scanning in which the carriage 15 is moved in the arrow $H_B$ direction.

As shown in FIG. 12, upon backward scanning, the printhead 5 discharges ink at positions 401 to 405 while moving in the arrow $H_B$ direction. At this time, the fifteenth nozzle, the twelfth nozzle, the ninth nozzle, the sixth nozzle and the third nozzle discharge ink to block the light axis 83 of the light beam, at the respective positions.

In this manner, ink is discharged from the five nozzles in correspondence with the movement of the printhead 5, and information on the respective discharge statuses are obtained from outputs from the photoreception device 82. When the printhead 5 further moves in the arrow $H_B$ direction to a position 407, similar ink discharge operation is performed by an adjacent nozzle array. In this manner, the ink-discharge statuses of the nozzles are detected while the printhead 5 moves in the arrow $H_B$ direction.

Note that the meanings and values of "L", "LP", "X" and "XP" in FIG. 12 are the same as those described in FIG. 9, therefore, the explanation of these alphabets will be omitted.

FIG. 12 shows an example where Y=3 holds as the interval (Y) between discharge nozzles. In this case, the printhead 5 performs ink discharge operation when the printhead 5 passes the light axis 83 thrice, thus the ink-discharge statuses of all the 16 nozzles can be detected. Further, in backward scanning, the ink-discharge status detection can be performed at the same carriage moving speed as in actual print operation.

Figure 13:
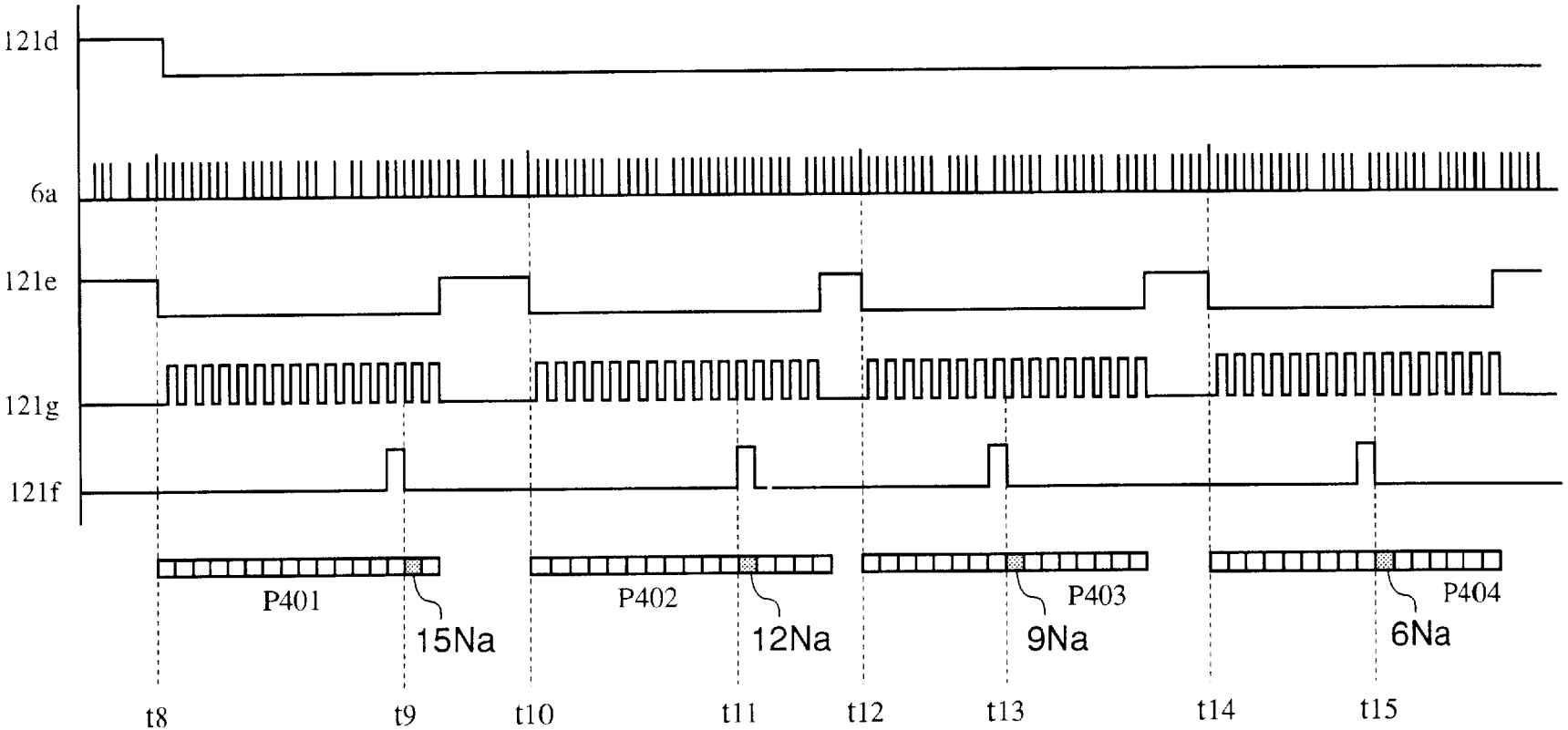
FIG. 13 is a timing chart showing various control signal timings in the ink-discharge status detection upon backward scanning corresponding to FIG. 12.

FIG. 13 is a timing chart showing various control signal timings in the ink-discharge status detection upon backward scanning corresponding to FIG. 12.

In FIG. 13, numerals P401 to P404 denote ink discharge timings on the timing chart corresponding to the positions 401 to 404 in FIG. 12, and represent nozzle positions to discharge ink by the control signals on the timing chart; 15Na, the fifteenth nozzle; 12Na, the twelfth nozzle; 9Na, the ninth nozzle; and 6Na, the sixth nozzle.

Referring to FIG. 13, when the reference signal (6*a*) from the linear encoder 72 has been outputted for a predetermined number of pulses (e.g., 34 pulses), the BVE* signal (121*d*) becomes active (low level) at time t=t8, and the ink-discharge status detection is started at the position 401. At the same time, the VE* signal (121*e*) of the nozzle array 5*a* of the printhead 5 becomes active (low level), then the image signal (121*f*) corresponding to the fifteenth nozzle is transferred with the image transfer synchronizing clock (121*g*), and the fifteenth nozzle (15Na) discharges ink at time t=t9 at the position 401. Next, at time t=t10 where the number of pulses of the reference signal (6*a*) from the time t=t8 becomes "34", the ink-discharge status detection is started at the position 402.

Similarly to the ink-discharge status detection at the position 401, the VE* signal (121*e*) of the nozzle array 5*a* of the printhead 5 becomes active (low level), then the image signal (121*f*) corresponding to the twelfth nozzle is transferred with the image transfer synchronizing clock (121*g*), and the twelfth nozzle (12Na) discharges ink at time t=t11 at the position 402.

Hereinafter, similarly, at time t=t12 where the number of pulses of the reference signal (6*a*) from the time t=t10 becomes "34", the ink-discharge status detection is started at the position 403. At the position 403, the ninth nozzle (9Na) discharges ink at time t=t13. Further, at time t=t14 where the number of pulses of the reference signal (6*a*) from the time t=t12 becomes "34", the ink-discharge status detection is started at the position 404. At the position 404, the sixth nozzle (6Na) discharges ink at time t=t15.

In this manner, as it is apparent from FIG. 13, the ink-discharge operation is performed each time the reference signal (6*a*) from the linear encoder 72 has been counted for a predetermined number. This arrangement prevents fluctuation of ink discharge position of the carriage 15 due to unevenness of rotation of the carriage motor 30 or the like.

By performing the above-described ink-discharge status detection upon forward scanning and ink-discharge status detection upon backward scanning, the ink-discharge statuses of eleven nozzles can be detected by one reciprocation scanning of the printhead. Accordingly, if the remaining second, fifth, eighth, eleventh and fourteenth nozzles discharge ink upon the next forward scanning of the printhead, the ink-discharge status detection can be completed with respect to all the nozzles.

According to the above-described embodiment, the ink-discharge statuses of the nozzles of the printhead can be detected by only changing the ink discharge positions and image signal while performing the same print control as that in normal print operation. Since this unnecessitates any specific print control sequence for the ink-discharge status detection, print control can be simplified. In addition to this, it also unnecessitates any specific mechanism for execution of the specific print control sequence. Thus, the mechanism of the apparatus itself can be simplified.

Further, in the above-described embodiment, some of the printing elements are selected and the ink-discharge status detection is performed upon forward scanning and backward scanning of the printhead, however, the present invention is not limited to this arrangement. The present invention has a construction to select a predetermined number of printing elements of the printhead at each of plural scannings of the printhead, so as to perform discharge status detection with respect to all the printing elements in the plural scannings of the printhead. For example, it may be arranged such that the discharge status detection is performed only upon forward or backward scanning. Further, at all the scannings in print operation, if a construction to select a predetermined number of printing elements and perform discharge status detection is employed, the occurrence of discharge failure can be considerably quickly detected.

Further, as the ink-discharge status detection in the above-described embodiment can be implemented in the reciprocal scanning of the printhead in normal print operation, the reduction of printing speed due to the ink-discharge status detection can be prevented.

Note that in the above-described embodiment, one nozzle array of the printhead 5 has 16 nozzles, however, the present invention is not limited to this number of nozzles. The number of nozzles can be freely set to, e.g., 32, 48, or 64. Further, as long as the above equations (1) to (3) are satisfied, the size of the printhead, the printing speed, the angle of the light beam to the nozzle array can be arbitrarily set.

Note that in the above embodiment, the liquid droplets discharged from the printhead have been described as ink, and the liquid contained in the ink tank has been described as ink, however, the liquid is not limited to ink. For example, to increase fixability and water repellent capability of printed image, or to improve image quality, processed liquid or the like to be discharged to a print medium may be contained in the ink tank.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision print operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum print medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive an ink from the apparatus main unit upon being mounted on the apparatus main unit or a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the print operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multicolor mode using a plurality of different colors or a full-color mode achieved by color mixing can be implemented in the printer either by using an integrated printhead or by combining a plurality of printheads.

Moreover, in each of the above-mentioned embodiment of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a print medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiment, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiment are realized by executing the program codes which are read by a computer, the present invention includes a case where an OS (operating system) or the like working on the computer performs a part or entire processes in accordance with designations of the program codes and realizes functions according to the above embodiment.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiment.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which performs printing by discharging ink onto a print medium while scanning a printhead, based on an ink-jet method, having a plurality of printing elements, said apparatus comprising:

scan means for scanning said printhead;

print means for performing print operation by using said printhead;

test discharge means for controlling operation of said printhead to select at least a part of said plurality of printing elements and perform test ink discharge while said scan means scans said printhead;

detection means for detecting ink-discharge statuses of said plurality of printing elements of said printhead from the test ink discharge by said test ink discharge means; and first control means for controlling said test discharge means to sequentially select said printing elements of said printhead at each of plural scannings of said printhead by said scan means, and controlling said detection means to detect the ink-discharge statuses, wherein said detection means includes:

light emission means for emitting a light beam; and photoreception means for receiving said light beam, wherein said printhead is provided such that ink droplets discharged from said plurality of printing elements block said light beam, wherein said light emission means and said photoreception means are provided such that a light axis of said light beam intersects an array direction of the plurality of printing elements of said printhead, thereby detecting ink discharge status of a part of the plurality of printing elements, and wherein said plurality of printing elements selected by said test discharge means are determined based on a distance between said plurality of printing element arrays, a moving speed of said printhead, the number of printing elements consisting said plurality of printing element arrays, the length of printing by each of said plurality of printing element arrays, a printing resolution in a printhead scanning direction, an ink discharge period in the printhead scanning direction, and a distance between said printing elements of said printing element arrays.

2. The apparatus according to claim 1, wherein said detection means is provided between a home position of said printhead, at one end of a scanning path of said printhead, and a position outside of an effective printing area for said printhead.

3. The apparatus according to claim 1, wherein said test discharge means includes:

first test discharge means for controlling the operation of said printhead to select a part of said plurality of printing elements and perform test ink discharge while said scan means scans said printhead in a forward direction; and second test discharge means for controlling the operation of said printhead to select another part of said plurality of printing elements, different from the part of said printing elements selected by said first test discharge means, and perform ink discharge while said scan means scans said printhead in a backward direction.

4. The apparatus according to claim 3, further comprising:

analysis means for detecting ink discharge statuses obtained by said first and second test discharge means by using said detection means, and analyzing operation statuses of said plurality of printing elements of said printhead based on the results of detection; and second control means for controlling the print operation by said print means based on analysis result by said analysis means.

5. The apparatus according to claim 3, wherein the ink discharge statuses of all of said plurality of printing elements of said printhead can be detected by operating said first and second test discharge means totally a predetermined number of times.

6. The apparatus according to claim 1, wherein said plurality of printing elements of said printhead are arrayed in one line.

7. The apparatus according to claim 1, wherein said test discharge means uses a control signal the same as that used by said print means, and performs the ink discharge only by changing image data and timing for ink discharge.

8. The apparatus according to claim 1, wherein a moving speed of said printhead while said test discharge means operates and that while said print means performs the print operation are the same.

9. The apparatus according to claim 1, wherein said printhead is a color printhead which discharges ink of plural colors, and which has a plurality of printing element arrays each comprising said plurality of printing elements corresponding to said plural colors.

10. The apparatus according to claim 1, wherein said printhead has discharge nozzles to discharge ink corresponding to each of said plurality of printing elements.

11. The apparatus according to claim 1, wherein said printhead has electrothermal transducers for generating thermal energy to be provided to ink, so as to discharge the ink by utilizing the thermal energy.

12. An ink-discharge status detection method used upon printing by discharging ink onto a print medium while scanning a printhead, based on an ink-jet method, having a plurality of printing elements, said method comprising:

a test discharge step of controlling operation of said printhead to select at least a part of said plurality of printing elements and perform test ink discharge while scanning said printhead;

a detection step of detecting ink-discharge statuses of said plurality of printing elements of said printhead based on the test ink discharge at said test ink discharge step by using a detection unit including a light emission device for emitting a light beam and a photoreception device for receiving the light beam, wherein said printhead is provided such that ink droplets discharged from said plurality of printing elements block the light beam, and the light emission device and the photoreception device are provided such that a light axis of the light beam intersects an array direction of the plurality of printing elements of said printhead, thereby detecting ink discharge status of a part of the plurality of printing elements; and a control step of controlling execution of said test discharge step to sequentially select said printing elements of said printhead at each of plural scannings of said printhead, and controlling execution of said detection step to detect the ink-discharge statuses, wherein said plurality of printing elements selected by said test discharge step are determined based on a distance between said plurality of printing element arrays, a moving speed of said printhead, the number of printing elements consisting said plurality of printing element arrays, the length of printing by each of said plurality of printing element arrays, a printing resolution in a printhead scanning direction, an ink discharge period in the printhead scanning direction, and a distance between said printing elements of said printing element arrays.

13. The method according to claim 12, wherein said detection step is performed when said printhead is situated between a home position of said printhead, at one end of a scanning path of said printhead, and a position outside of an effective printing area for said printhead.

* * * * *